US005935904A

United States Patent [19]

Shirai et al.

[11] Patent Number: 5,935,904

[45] Date of Patent: Aug. 10, 1999

[54] THERMAL TRANSFER IMAGE-RECEIVING SHEET

[75] Inventors: Koichi Shirai; Kazunobu Imoto, both of Tokyo-To, Japan

[73] Assignee: Dai Nippon Printing Co., Ltd., Japan

[21] Appl. No.: 08/905,737

[22] Filed: Aug. 4, 1997

Related U.S. Application Data

[62] Division of application No. 08/393,992, Feb. 24, 1995, Pat. No. 5,698,489.

[30] Foreign Application Priority Data

| | | | |
|---|---|---|---|
| Feb. 25, 1994 | [JP] | Japan | 6-51037 |
| Jul. 1, 1994 | [JP] | Japan | 6-173678 |
| Aug. 1, 1994 | [JP] | Japan | 6-199041 |

[51] Int. Cl.[6] ..... B41M 5/035; B41M 5/38

[52] U.S. Cl. ..... 503/227; 428/195; 428/304.4; 428/500; 428/913; 428/914

[58] Field of Search ..... 8/471; 428/195, 428/304.4, 913, 914, 500; 503/227

[56] References Cited

U.S. PATENT DOCUMENTS

| | | | |
|---|---|---|---|
| 4,992,414 | 2/1991 | Kishida et al. | 503/227 |
| 5,096,877 | 3/1992 | Kushi et al. | 503/227 |
| 5,244,861 | 9/1993 | Campbell et al. | 503/227 |

FOREIGN PATENT DOCUMENTS

| | | | |
|---|---|---|---|
| 0 322 771 A2 | 7/1989 | European Pat. Off. | 503/227 |
| 0 322 771 A3 | 7/1989 | European Pat. Off. | 503/227 |
| 0 409 597 A2 | 1/1991 | European Pat. Off. | 503/227 |
| 0 409 597 A3 | 1/1991 | European Pat. Off. | 503/227 |
| 0 519 483 A2 | 12/1992 | European Pat. Off. | 428/375 |
| 0 519 483 A3 | 12/1992 | European Pat. Off. | 503/227 |
| 0 551 894 A1 | 7/1993 | European Pat. Off. | 503/227 |
| 63-315293 | 12/1988 | Japan | 503/227 |
| 1-280586 | 11/1989 | Japan | 503/227 |
| 3-211089 | 9/1991 | Japan | 503/227 |
| 4-21985 | 1/1992 | Japan | 503/227 |
| 59-142189 | 8/1994 | Japan | 503/227 |
| WO 92/06577 | 4/1992 | WIPO | 428/304.4 |
| WO 94/21470 | 9/1994 | WIPO | 503/227 |

OTHER PUBLICATIONS

Patent Abstracts of Japan—Publ. No. JP1198388; Publ. Date: Aug. 9, 1989; Appl. No. JP880023337; Appl. Date: Feb. 3, 1988; vol. 13, No. 498; Inventor: Hayama Kazuhide et al.; Title: Image Receiving Sheet For Thermal Transfer Recording; Patent Date: Aug. 9, 1989; Patentee: Mitsubishi Petrochem.Co. Ltd.

Patent Abstracts Of Japan—vol. 14, No. 52 (M–928), Jan. 30, 1990 and JP–A–01 280586 (Mitsubishi Kasei Corp), Nov. 10, 1989.

*Primary Examiner*—Bruce H. Hess

*Attorney, Agent, or Firm*—Parkhurst & Wendel, L.L.P

[57] ABSTRACT

A thermal transfer image-receiving sheet including a substrate sheet and a colorant-receptive layer, the substrate sheet having microvoids and having been formed by extruding a composition including a polyester resin and a polyolefin resin and biaxially stretching the resultant extrudate, the number of microvoids in the section of the substrate sheet being $3.7\times10^4$ to $2.2\times10^5/mm^2$. Additionally, a thermal transfer image-receiving sheet including a substrate and a colorant-receptive layer, the substrate including a plastic film having microvoids, the fractal dimension of the microvoids being not less than 1.45. Further, a thermal transfer image-receiving sheet including a substrate and, provided thereon in the following order, an adhesive layer composed mainly of a hydrophilic resin, a white opaque layer and a colorant-receptive layer.

3 Claims, 1 Drawing Sheet

5.0 ku × 5000 5μm

THERMAL TRANSFER IMAGE-RECEIVING SHEET

This is a Division of application Ser. No. 08/393,992 filed Feb. 24, 1995, now U.S. Pat. No. 5,698,489.

BACKGROUND OF THE INVENTION

1. Field of the Invention

The prevent invention relates to a thermal transfer image-receiving sheet and more particularly to a thermal transfer image-receiving sheet for use in a thermal transfer recording system wherein a sublimable dye is used as a colorant.

2. Background Art

Various thermal transfer recording systems are known in the art, and one of them is a dye sublimation transfer recording system in which a sublimable dye as a colorant is transferred from a thermal transfer sheet to an image-receiving sheet by means of a thermal head capable of generating heat in response to recording signals, thereby forming an image. In this recording system, since a dye is used as colorant and the gradation of the density is possible, a very sharp image can be formed and, at the same time, the color reproduction and tone reproduction of half tones are excellent, making it possible to form an image go having a quality comparable to that formed by silver salt photography.

By virtue of the above excellent performance and the development of various hardwares and softwares associated with multi-media, the dye sublimation transfer recording system has rapidly increased the market in a full-color hard copy system for computer graphics, static images through satellite communication, digital images represented by CD-ROM, and analog images such as video.

Specific applications of the image-receiving sheet in the dye sublimation transfer recording system are various, and representative examples thereof include proof printing, output of an image, output of a design, such as CAD/CAM, output applications for various medical instruments for analysis, such as CT scan, output applications for measuring equipment, alternatives for instant photography, output of photograph of a face to identification (ID) cards, credit cards, and other cards, and applications in composite photographs and pictures for keepsake in amusement facilities, such as pleasure grounds, museums, aquariums, and the like.

The thermal transfer image-receiving sheet for dye sublimation transfer used in the above various applications (hereinafter referred to simply as "thermal transfer image-receiving sheet" or "image-receiving sheet") generally comprises a substrate (referred to also as a "support") and a color-receptive layer formed thereon. What is first required of this image-receiving sheet is high sensitivity in printing and heat resistance. When the heat resistance is poor, heating at the time of printing causes curling or traces of a thermal head on the surface of the image-receiving sheet, deteriorating the image quality. Regarding the sensitivity in printing, an increase in a dye sublimation transfer recording speed in recent years has led to a strong demand for an image-receiving sheet having high sensitivity in printing.

The properties of the color-receptive layer are, of course, important to the sensitivity of the image-receiving sheet in printing. In addition, the properties of the substrate are also very important.

Various substrates have hitherto been proposed for the purpose of improving the sensitivity in printing and the heat resistance of the image-receiving sheet.

For example, Japanese Patent Laid-Open No. 136783/1989 teaches that a substrate which uses, as a part or the entirety thereof, a film having microvoids in its interior, prepared by extruding and biaxially stretching a resin composition comprising a mixture of polyethylene terephthalate with an inorganic pigment and an olefin, and which has a particular degree of cushioning, possesses high sensitivity in printing and thus can provide a sharp image.

Japanese Patent Laid-Open No. 168493/1989 teaches that good results can be obtained when a substrate prepared in the same manner as the substrate described in Japanese Patent Laid-Open No. 136783/1989 has closed cells in its interior and a particular specific gravity.

Japanese Patent Laid-Open No. 207694/1991 specifies the density of the substrate.

Japanese Patent Laid-Open Nos. 16539/1993 and 169865/1993 describe substrates having a particular percentage void, and Japanese Patent Laid-Open No. 246153/1993 describes a substrate comprising a particular material and having particular density and voids.

Further, Japanese Patent Laid-Open Nos. 115687/1989, 263691/1990, and 290790/1988 disclose substrates wherein the sensitivity in printing is improved by improving the cushioning and insulating properties.

According to the studies by the present inventors, however, all the above substrates are still unsatisfactory in at least one of sensitivity in printing and heat resistance.

Regarding properties required of the thermal transfer image-receiving sheet, in addition to the above described high sensitivity in printing and heat resistance, there is also an ever-increasing demand in the market in recent years for sufficient whiteness, opacity, and uniform appearance (uniform surface independently of whether the surface is glossy or matte), according to intended uses of image-receiving sheets.

Further, with a recent increase in recording speed (line speed) in the dye sublimation transfer system, the temperature of the thermal head of a printer is becoming higher. With an increase in the temperature of the thermal head, delamination between the substrate of the thermal transfer image-receiving sheet and the layers overlying the substrate is more likely to occur.

Especially in the case of an image-receiving sheet provided with a white opaque layer between the substrate and the colorant-receptive layer, since a white inorganic pigment is present in the white opaque layer, the adhesion between the substrate and the white opaque layer is likely to be poor, which is likely to cause delamination between the substrate and the white opaque layer during printing, making it impossible to provide a high-quality image. Further, the delamination gives rise to carrying error in a printer.

Various attempts have been made to enhance the adhesion between the substrate of the image-receiving sheet and a layer overlying the substrate.

For example, Japanese Patent Laid-Open No. 211089/1991 teaches a surface modification of a polyester film as a substrate by a corona or plasma treatment. However, the adhesive property imparted by the corona or plasma treatment is unstable and it decreases with the elapse of time.

Furthermore, Japanese Patent Laid-Open No. 211089/1991 describes an alternative method wherein a resin, such as an acrylic resin, having good adhesion both to the colorant-receptive layer and to the substrate is applied. However, the use as an adhesive layer of such resins as an acrylic resin, which are soluble in organic solvents, has the following problem. When a coating solution for a colorant-receptive layer, in which an organic solvent is generally used, is coated on the adhesive resin layer, the adhesive layer is attacked by the organic solvent contained in the coating solution, which remarkably deteriorates the appearance of the image-receiving sheet to lower the commercial value of the product.

Accordingly, an object of the present invention is to provide a thermal transfer image-receiving sheet having high sensitivity in printing and heat resistance.

Another object of the present invention is to provide a thermal transfer image-receiving sheet having a white opaque layer, which is excellent in adhesion between the substrate and the white opaque layer and has excellent appearance.

SUMMARY OF THE INVENTION

The present inventors have found that the use of a substrate composed of a specific resin and having a specific number of microvoids can provide a thermal transfer image-receiving sheet having high sensitivity in printing and high heat resistance.

Thus, according to a first aspect of the present invention, there is provided a thermal transfer image-receiving sheet comprising a substrate sheet and a colorant-receptive layer, said substrate sheet having microvoids and having been formed by extruding a compound comprising a polyester resin and a polyolefin resin and biaxially stretching the resultant extrudate, the number of microvoids in the section of said substrate sheet being $3.7\times10^4$ to $2.2\times10^5/mm^2$.

Further, the present inventors have found that a thermal transfer image-receiving sheet having high sensitivity in printing and high heat resistance can also be provided by using as a substrate a plastic film having microvoids meeting a particular requirement.

Thus, according to a second aspect of the present invention, there is provided a thermal transfer image-receiving sheet comprising a substrate and a colorant-receptive layer, said substrate comprising a plastic film having microvoids, the fractal dimension of said microvoids being not less than 1.45.

Furthermore, the present inventors have found that, in a thermal transfer image-receiving sheet having a white opaque layer, the adhesion between the white opaque layer and the substrate can be significantly improved by providing a particular adhesive layer between the white opaque layer and the substrate.

Thus, according to a third aspect of the present invention, there is provided a thermal transfer image-receiving sheet comprising a substrate and, provided thereon in the following order, an adhesive layer composed mainly of a hydrophilic resin, a white opaque layer and a colorant-receptive layer.

The thermal transfer image-receiving sheets according to the first and second aspects of the present invention have high sensitivity in printing and, at the same time, excellent heat resistance. Therefore, these image-receiving sheets effectively prevent the occurrence of curling due to heat upon printing, exhibit no traces of a thermal head on an image face and can produce a high- density, high-quality image.

The thermal transfer image-receiving sheet according to the third aspect of the present invention can significantly improve the adhesion between the white opaque layer and the substrate without sacrificing the appearance.

DETAILED DESCRIPTION OF THE INVENTION

Figure 1:
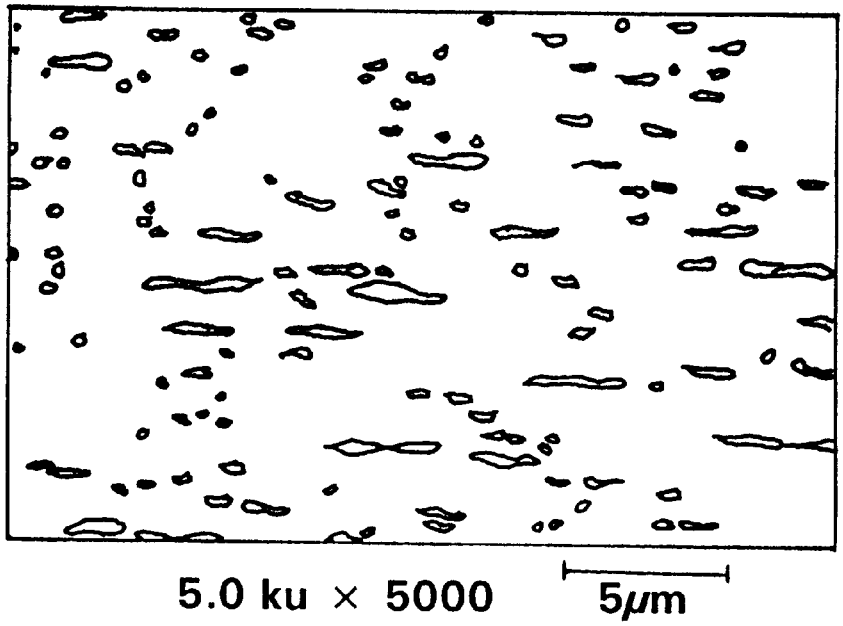
FIG. 1 is a conceptual diagram showing the shape and distribution of microvoids contained in the substrate sheet of the thermal transfer image-receiving sheet according to the first aspect of the present invention.

Image-receiving sheet having specific number of microvoids

The thermal transfer image-receiving sheet according to the first aspect of the present invention comprises a substrate sheet and a colorant-receptive layer, said substrate sheet having microvoids and having been formed by extruding a compound comprising a polyester resin and a polyolefin resin and biaxially stretching the resultant extrudate, the number of microvoids in the section of said substrate sheet being $3.7\times10^4$ to $2.2\times10^6/mm^2$.

Substrate sheet

Examples of the polyester resin to be used for the substrate sheet include polyethylene terephthalate and polybutylene terephthalate. Polyethylene terephthalate is most preferred. The polyester resin, by virtue of its excellent heat resistance, can prevent the occurrence of curling due to heat upon printing and the development of traces of a thermal head on an image face. The use of the polyester resin alone, however, causes lack of flexibility as the substrate sheet, and, for this reason, a polyolefin resin is added to the polyester resin to impart plasticity.

Examples of the polyolefin resin usable for this purpose include polyethylene, polypropylene, ethylene/vinyl acetate copolymer, polymethylpentene, ethylene/acrylic acid copolymer, ethylene/acrylic ester copolymer, and α-alkyl olefin-modified olefin resins. Among them, polypropylene and polymethylpentene are preferred. The amount of the polyolefin resin used is preferably 5 to 30 parts by weight based on 100 parts by weight of the polyester resin from the viewpoint of a balance between the heat resistance and the flexibility of the substrate sheet. If necessary, other polymers including rubbers, such as polyisoprene, acrylic resins, such as polymethyl methacrylate, and polystyrene resin nay be used in an amount up to 10% by weight based on the total amount of the polyester and the polyolefin.

The substrate sheet may, if necessary, contain inorganic fine particles as a filler and additives such as a brightening agent. The inorganic fine particles used as a filler include white pigments or extender pigments commonly used in the art, such as titanium oxide, calcium carbonate, talc, aluminum hydroxide, and silica. The addition of these fine particles can impart opacity and whiteness to the resulting image-receiving sheet. The amount of these fine particles added is preferably 1.5 to 4.0 parts by weight based on 100 parts by weight of the above resins.

The substrate sheet has microvoids in the particular number specified above. The microvoids can be formed by conducting proper biaxial stretching in the preparation of the substrate sheet by mixing the above polyester and polyolefin resins and optionally the above polymer, filler or additives, a surfactant, a foaming agent, etc., extruding the resulting compound through a die to form into a sheet. The mechanism by which the microvoids are formed is as follows.

When the above compound contains as a filler the above inorganic fine particles, the inorganic fine particles, during biaxial stretching, serve as a nucleus to form microvoids. Even when the compound does not contain inorganic fine particles, the microvoids are formed through another mechanism.

Thus, in the mixture of a polyester with a polyolefin, the polyester and the polyolefin are compatible with each other but not miscible with each other. That is, the mixture has an islands(polyolefin)-sea(polyester) structure as viewed microscopically.

Stretching of the mixture having an islands-sea structure causes cleavage at the interface of sea and islands or deformation of the polyolefin constituting the islands, thereby forming microvoids.

When the compound contains inorganic fine particles, the microvoids are formed through the above two mechanisms with the contribution of the latter mechanism to the formation of microvoids being larger.

In the present invention, stretching conditions, such as stretch ratio, are set so that the number of microvoids observed in the section of the substrate sheet is $3.7\times10^4$ to $2.2\times10^5/mm^2$. The above number of microvoids is the average value of the number of microvoids in the section in the longitudinal direction and the number of microvoids in the section in the transverse direction of the substrate sheet. By bringing the number of microvoids to $3.7\times10^4/mm^2$ or more, the cushioning property and the heat-insulating property of the substrate sheet can be improved and, at the same time, the sensitivity of the image-receiving sheet in printing can be improved. However, when the number of microvoids exceeds $2.2\times10^5/mm^2$, the percentage void of the whole sheet is increased, raising problems of deterioration in heat resistance, heat curling, and traces of a thermal head of the substrate sheet. This results in lowered overall performance and commercial value of the image-receiving sheet.

Figure 2:
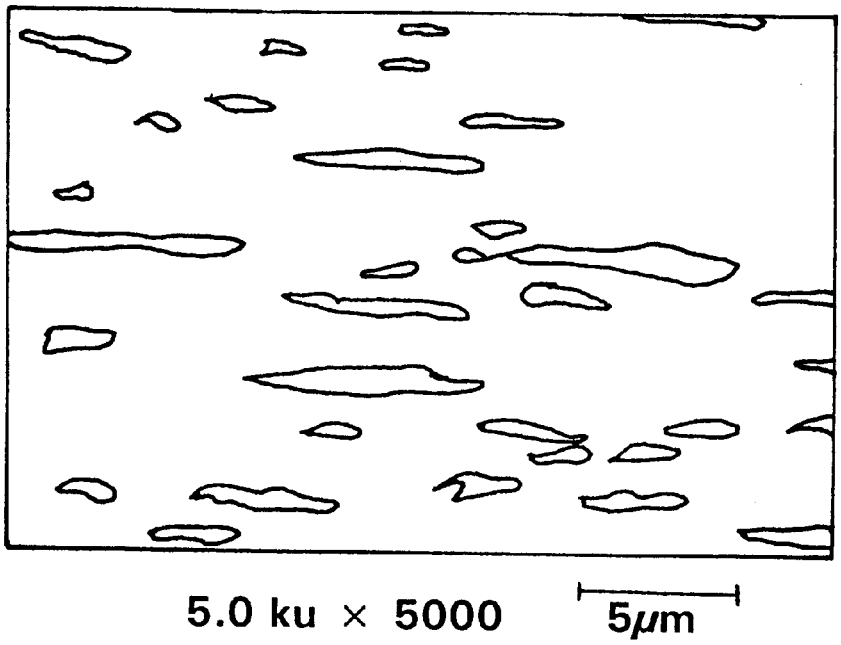
FIG. 2 is a conceptual diagram, to be compared with FIG. 1, showing the state of microvoids in the case where the number of microvoids in the substrate sheet is outside the scope of the present invention (smaller than the number of microvoids specified in the present invention).

FIG. 1 is a conceptual diagram showing the shape and distribution of microvoids in the substrate sheet, having microvoids the number of which is in the above specified range, according to the present invention, and FIG. 2 is a conceptual diagram showing the shape and distribution of microvoids in a substrate sheet, as prepared in comparative examples described below, having microvoids the number of which is smaller than the lower limit of the above specified range. As is apparent from the both drawings, the microvoids shown in FIG. 2 are flatter than those shown in FIG. 1. Further, it is apparent that, for the size of individual microvoids, the microvoids shown in FIG. 1 are, on the average, smaller than those shown in FIG. 2.

For the microvoids, as shown in FIG. 1, falling within the particular range specified above in terms of the number of microvoids, the major axis is approximately 1 to 20 $\mu$m, and the minor axis is approximately 0.5 to 4 $\mu$m with the minor axis to major axis ratio being 0.01 to 0.50.

Colorant-receptive layer

The resin usable for the colorant-receptive layer may be any resin conventionally used for dye sublimation thermal transfer image-receiving sheets. Specific examples of the resin include polyolefin resins, such as polypropylene; halogenated resins, such as polyvinyl chloride and polyvinylidene chloride; vinyl resins, such as polyvinyl acetate and polyacrylic ester, and copolymers thereof; polyester resins, such as polyethylene terephthalate and polybutylene terephthalate; polystyrene resins; polyamide resins; copolymers of olefins, such as ethylene or propylene, with other vinyl monomers; ionomers; and cellulose derivatives. These resins may be used alone or as a mixture of two or more. Of these resins, polyester resins and vinyl resins are preferred.

The colorant-receptive layer may contain a release agent for the purpose of preventing heat fusing between the colorant-receptive layer and a thermal transfer sheet during the formation of an image. Silicone oil, phosphate plasticizers, and fluorine compounds may be used as the release agent. Among them, silicone oil is preferred. The amount of the release agent added is preferably 0.2 to 30 parts by weight based on the resin for forming the receptive layer.

The colorant-receptive layer may be coated on the substrate sheet by conventional methods, such as roll coating, bar coating, gravure coating, and gravure reverse coating. The coverage thereof is preferably 0.5 to 10 $g/m^2$ (on a solid basis).

Additional layer

The thermal transfer image-receiving sheet of the present invention may consist of the above substrate sheet and the above colorant-receptive layer alone. If necessary, however, additional layers may be provided.

For example, in order to impart high whiteness and opacity to the image-receiving sheet, a white opaque layer may be provided between the substrate sheet and the colorant-receptive layer.

The white opaque layer may comprise a mixture of a known white inorganic pigment, such as titanium oxide or calcium carbonate, with a binder. The binder may be one of or a blend of known resins such as polyurethane, polyester, polyolefin, modified polyolefin, and acrylic resins.

Further, in order to improve the resistance of the image-receiving sheet to curling associated with printing or curling associated with environment, various plastic films or various types of paper may be laminated on the image-receiving sheet. More specifically, coated paper, art paper, wood-free paper, glassine paper, resin EC paper, a polyester, polypropylene, or the like may be laminated onto the substrate sheet on its side remote from the receptive layer. Further, if necessary, the substrate may have a sandwich structure comprising a core formed of one of the above various types of paper or plastic films and substrate sheets laminated onto the both sides of the core.

The following examples further illustrate the present invention but are not intended to limit it.

In the following examples, "parts" are by weight, and the coverage of the colorant-receptive layer is on a dry basis.

EXAMPLE A1

Compound 1 having the following composition was extruded, and the extrudate was biaxially stretched to prepare a 125 $\mu$m-thick substrate sheet. The number of microvoids in the section of the substrate sheet was $7.84\times10^4/mm^2$.

| Compound 1 | |
|---|---|
| Polyester (FR-PET, manufactured by Teijin Chemicals Ltd.) | 100 parts |
| Polymethylpentene (TPX, manufactured by Mitsui Petrochemical Industries, Ltd.) | 10 parts |
| Titanium oxide (average particle diameter: 2 $\mu$m, anataze type) | 2 parts |

The substrate sheet was coated with a coating solution, for a receptive layer, having the following composition by gravure reverse coating at a coverage of 4.0 $g/m^2$ to prepare a thermal transfer image-receiving sheet.

| Coating solution for receptive layer | |
|---|---|
| Vinyl chloride/vinyl acetate copolymer (#1000A, manufactured by Denki kagaku Kogyo K.K.) | 7.2 parts |
| Styrene/methyl methacrylate copolymer (#400A, manufactured by Denki kagaku Kogyo K.K.) | 1.6 parts |
| Polyester (Vylon 600, manufactured by Toyobo Co., Ltd.) | 11.2 parts |
| Vinyl-modified silicone (X-62-1212, manufactured by Shin-Etsu Chemical Co., Ltd.) | 2 parts |
| Methyl ethyl ketone | 39 parts |
| Toluene | 39 parts |

EXAMPLE A2

Compound 2 having the following composition was extruded, and the extrudate was biaxially stretched to prepare a 125 μm-thick substrate sheet. The number of microvoids in the section of the substrate sheet was $5.91\times10^4/mm^2$.

| Compound 2 | |
|---|---|
| Polyester (as used in Example A1) | 100 parts |
| Polypropylene (MA2, manufactured by Mitsubishi Petrochemical Co., Ltd.) | 10 parts |
| Calcium carbonate (average particle diameter: 3.5 μm) | 2 parts |

The substrate sheet was coated with the same coating solution for a receptive layer as in Example A1 in the same manner as in Example A1, thereby preparing a thermal transfer image-receiving sheet.

EXAMPLE A3

Compound 1 as used in Example A1 was extruded, and the extrudate was biaxially stretched to prepare a 75 μm-thick sheet. This sheet was laminated onto the both sides of OK Coat (basis weight: 72.3 $g/m^2$, manufactured by New Oji Paper Co., Ltd.). The resultant laminate on its one surface was coated with a coating solution, for a white opaque layer, having the following composition, thereby forming a white opaque layer which was then coated with the same coating solution, for a receptive layer, as used in Example A1, thereby preparing an image-receiving sheet.

| Coating solution for white opaque layer | |
|---|---|
| Binder (N-2303, manufactured by Nippon Polyurethane Industry Co., Ltd.) | 10 parts |
| White pigment ($TiO_2$, average particle diameter 0.5 μm) | 15 parts |
| Organic solvent | 60 parts |

EXAMPLE A4

Compound 3 having the following composition was extruded, and the extrudate was biaxially stretched to prepare a 35 μm-thick substrate sheet. The number of microvoids in the section of the substrate sheet was $8.52\times10^4/mm^2$.

| Compound 3 | |
|---|---|
| Polypropylene (as used in Example A2) | 100 parts |
| Polyethylene terephthalate (as used in Example A1) | 10 parts |
| Polyethylene (Mirason 16P, manufactured by Mitsui Nisseki Polymers Co., Ltd.) | 2 parts |

The substrate sheet was laminated onto the both sides of OK Coat (basis weight: 157 $g/m^2$ manufactured by New Oji Paper Co., Ltd.) by dry lamination. The laminate on its one side was coated with the coating solution for a receptive layer as used in Example A1 in the same manner as in Example A1, thereby preparing a thermal transfer image-receiving sheet.

EXAMPLE A5

Compound 4 having the following composition was extruded, and the extrudate was biaxially stretched to prepare a 35 μm-thick substrate sheet. The number of microvoids in the section of the substrate sheet was $6.72\times10^4/mm^2$.

| Compound 4 | |
|---|---|
| Polypropylene (as used in Example A2) | 100 parts |
| Polyethylene terephthalate (as used in Example A1) | 8 parts |
| Polyisoprene (JSR-Butyl No. 268, manufactured by Japan Synthetic Rubber Co., Ltd.) | 3 parts |

The substrate sheet was laminated onto the both sides of OK Coat (basis weight: 157 $g/m^2$, manufactured by New Oji Paper Co., Ltd.) by dry lamination. The laminate on its one side was coated with the coating solution for a receptive layer as used in Example A1 in the same manner as in Example A1, thereby preparing a thermal transfer image-receiving sheet.

Comparative Example A1

A 125 μm-thick substrate sheet was prepared using the compound as used in Example A1 in the same manner as in Example A1, except that the sheet forming temperature and the stretch ratio were lower than those used in Example A1. The number of microvoids in the section of the substrate sheet thus obtained was $3.4\times10^4/mm^2$. Thereafter, the substrate sheet was coated with the coating solution for a receptive layer as used in Example A1 in the same manner as in Example A1, thereby preparing a thermal transfer image-receiving sheet.

Comparative Example A2

Crysper (thickness: 125 μm, manufactured by Toyobo Co., Ltd.), a polyester sheet not containing a polyolefin, on its one side was coated with the coating solution for a receptive layer as used in Example A1 by gravure reverse coating at a coverage of 3.5 $g/m^2$, thereby preparing a thermal transfer image-receiving sheet.

Comparative Example A3

Compound 5 having the following composition was extruded, and the extrudate was biaxially stretched to prepare a 125 μm-thick substrate sheet. The number of microvoids in the section of the substrate sheet was $3.0\times10^4/mm^2$.

| Compound 5 | |
|---|---|
| Polyester (as used in Example A2) | 100 parts |
| Polypropylene (as used in Example A2) | 32 parts |
| Calcium carbonate (as used in Example A2) | 2 parts |

The above substrate sheet was coated with the coating solution for a receptive layer as used in Example A2 in the same manner as in Example A2, thereby preparing a thermal transfer image-receiving sheet.

Comparative Example A4

The procedure of Example A1 was repeated, except that stretching conditions, such as stretch ratio, were changed so that the number of microvoids of the substrate sheet formed was $3.1\times10^4/m^2$.

A test pattern was printed on the thermal transfer image-receiving sheets prepared in the above examples and comparative examples under the conditions of an applied voltage of 12 V and a printing speed of 16 msec/line, and the gloss, uniformity of print, sensitivity in printing, and curling as a measure of heat resistance were evaluated by the following methods. The results are given in Table A1.

Evaluation methods

Gloss, uniformity of print, and curling: They were evaluated by visual inspection.

Sensitivity in printing: The reflection density was measured with a Macbeth densitometer, and the sensitivity in printing was evaluated based on the optical density 1.0 of the print in Example A1.

The sensitivity in printing is a relative value of the density.

In Table A1, the symbols denote the following.

O: good

Δ: somewhat poor, but no problem for practical use

X: unacceptable

The number of microvoids given in Table A1 is one determined by measuring the number of microvoids in the section of an image-receiving sheet under an electron microscope (SEM) and converting the measured value to a value per unit sectional area ($mm^2$) of the image-receiving sheet.

TABLE A1

| Example No. | Gloss | Uniformity of print | Curling | Sensitivity in printing (evaluation) | Number of microvoids (microvoids/$mm^2$) |
|---|---|---|---|---|---|
| Ex. A1 | ○ | ○ | ○ | 1.00 (○) | $7.84\times10^4$ |
| Ex. A2 | ○ | ○ | ○ | 0.96 (○) | $5.91\times10^4$ |
| Ex. A3 | ○ | ○ | ○ | 0.98 (○) | $7.84\times10^4$ |
| Ex. A4 | ○ | Δ | ○ | 1.06 (○) | $8.52\times10^4$ |
| Ex. A5 | ○ | ○ | ○ | 0.98 (○) | $6.72\times10^4$ |
| Comp. Ex. A1 | ○ | ○ | ○ | 0.88 (Δ) | $3.40\times10^4$ |
| Comp. Ex. A2 | ○ | X | ○ | 0.66 (X) | — |
| Comp. Ex. A3 | Δ | ○ | X | 0.95 (○) | $3.00\times10^4$ |
| Comp. Ex. A4 | Δ | ○ | X | 0.84 (Δ) | $3.10\times10^4$ |

Image-receiving sheet having microvoids of particular fractal dimension

The thermal transfer image-receiving sheet according to the second aspect of the present invention comprises a substrate and a colorant-receptive layer, said substrate comprising a plastic film having microvoids, the fractal dimension of said microvoids being not less than 1.45.

Substrate

The substrate comprises a plastic film having microvoids and an optional layer described below.

The plastic film may be prepared by the following two methods.

In the first method, a resin is mixed with inorganic fine particles and the resulting mixture (compound) is extruded into a film, whereupon a suitable biaxial stretching is conducted on the film. In this stretching, the inorganic fine particles serve as a nucleus to form voids in the film. Examples of the resin used include various polyolefin resins, such as polypropylene, and polyester resins. Among the polyester resins, polyethylene terephthalate is particularly preferred.

Examples of the inorganic fine particles to be mixed with the above resin include titanium oxide, calcium carbonate, barium carbonate, barium sulfate, zinc oxide, and other known white pigments. The amount of inorganic fine particles may be 1 to 10 parts by weight based on 100 parts by weight of the resin.

In the second method for preparing the plastic film having microvoids, a resin as a main component is mixed with a polymer immiscible with the resin, and the resulting mixture is extruded into a film, whereupon a suitable biaxial stretching is conducted on the film. The microscopic observation of the mixture reveals that the resin and the polymer together constitute a fine islands-sea structure. The formation of a film from the mixture followed by stretching of the film causes cleavage at the interface of the islands-sea structure or large deformation of the resin constituting the islands, resulting in the formation of microvoids.

The resin as a main component for constituting the plastic film may be the above resin, that is, a polyolefin or a polyester. Examples of the polymer immiscible with the resin include rubbers such as polyisoprene, acrylic resins such as polymethyl methacrylate, and resins such as polymethylpentene and polystyrene. The amount of the polymer used may be 2 to 10 parts by weight based on 100 parts by weight of the above resin. It is particularly preferred to use as the main resin polypropylene in combination with polymethyl methacrylate, polystyrene, polyisoprone, or a mixture thereof as the immiscible polymer. Polymethyl methacrylate is particularly preferred as the immiscible polymer.

In the present invention, it is important that the microvoids in the plastic film formed by the above methods have a fractal dimension of 1.45 or more.

The significance of this particular parameter will now be described.

For the sensitivity in printing of a dye sublimation transfer image-receiving sheet, the heat insulating property of the substrate is particularly important. The present inventors have found that a main factor governing the heat insulating property of the substrate is not the percentage void or density of the substrate but the shape or morphology of voids.

Specifically, when two substrates have the same percentage void and density but are different from each other in the morphology of voids, i.e., one of which has relatively uniform and large voids in a smaller number with the other having relatively ununiform smaller voids in a larger number, the latter provides higher sensitivity in printing and has better heat resistance. When the state or morphology of voids existing in the substrate is expressed in terms of the appearance of the voids in the section of the substrate, it can be said that more complicated shape or figure provides better results. The complexity of such a shape or figure of wicrovoids can be best defined in terms of "fractal index".

The "fractal dimension" is known as an index for expressing the complexity of the shape and distribution of an object. There are many known definitions of the fractal dimension. The definition, which is the most common and adopted in the present invention, is as follows.

The required minimum number of circles of r in radius entirely covering the microvoids in the section of a film is assumed to be N(r). In this case, when the size of r, i.e., the area of the circle, is varied, the N(r) value too is, of course, varied. This means that the object or shape in question is formed of circles, in a number of S, reduced in its whole size to 1/n. Therefore, the fractal dimension can be determined from the gradient of log-log plotting of the area Rs of the circle and N(r). That is, $$\mathrm{Log}N(r)=a\times\mathrm{Log}Rs+C$$

$$D=1-a$$

wherein D represents the fractal dimension.

A substrate having high sensitivity in printing and excellent heat resistance can be obtained when the fractal dimension of microvoids in the plastic film is made 1.45 or more. When the fractal dimension is less than 1.45, the substrate is poor essentially in the sensitivity in printing. Regarding the upper limit of the fractal dimension, when the fractal dimension is 2.0 or more, the microvoids should theoretically cover the whole section, which is actually impossible. According to studies by the present inventors, the upper limit of the fractal dimension is about 1.85 from the practical point of view.

The fractal dimension value in the above range can be attained by properly setting, depending upon the kind of the resin used, film forming conditions in the production of the plastic film, such as the degree of kneading of the compound and film stretching ratio.

When the above two methods for forming the plastic film are compared, the latter is more suitable for providing fractal dimension $\geqq 1.45$. In the latter method, the islands-sea structure in the mixture can be made very fine simply by an adequate kneading of the resins, whereby relatively ununiform small microvoids having a complicated shape can be obtained more easily.

In the present invention, the above plastic film having microvoids whose fractal dimension is 1.45 or more is essentially used as the substrate. If desired, a plastic layer not having any microvoid and/or a plastic layer having microvoids whose fractal dimension is less than 1.45 may be laminated onto the above plastic film. This additional layer can be provided, for example, by co-extruding the material for forming this layer at the time of formation of the plastic film. The material for the additional layer can be the same as that for the layer having microvoids with a fractal dimension of 1.45 or more.

For example, a plastic film having a multilayer structure comprising a layer of a resin, such as polypropylene, as a core layer and, formed on the both sides thereof, layers of the plastic film having microvoids whose fractal dimension is 1.45 or more, may be used as the substrate. As such a plastic film having a multilayer structure, a commercially available synthetic paper can be employed, Further, it is also possible to use as the substrate a laminate comprising as a core layer the plastic film having microvoids, whose fractal dimension is 1.45 or more, and, laminated on the both sides of the core layer, opaque layers containing an inorganic pigment. These opaque layers can be formed by co-extrusion with the core layer.

Further, depending upon applications, a layer not having any microvoids may be provided on the layer having microvoids of the above synthetic paper or plastic film having a multilayer structure to form a laminate having a five-layer structure so as to obtain high gloss and surface smoothness. The thickness of the layer not having any microvoid is preferably 1 to 10 $\mu$m. A thickness of less than 1 $\mu$m is insufficient for imparting the gloss and smoothness. On the other hand, when the thickness exceeds 10 $\mu$m, the sensitivity in printing is lowered.

Furthermore, it is also possible to use as the substrate a laminate comprising the plastic film having microvoids whose fractal dimension is 1.45 or more and, laminated thereon, paper, a plastic film, or the like. In this case, the lamination is preferably conducted so as to provide a symmetric structure, i.e., by laminating plastic films having microvoids whose fractal dimension is 1.45 or more onto the both sides of paper or PET as a core layer.

Colorant-receptive layer

The resin usable for the colorant-receptive layer may be any resin conventionally used for dye sublimation thermal transfer image-receiving sheets. Specific examples of the resin include polyolefin resins, such as polypropylene; halogenated resins, such as polyvinyl chloride and polyvinylidene chloride; vinyl resins, such as polyvinyl acetate and polyacrylic ester, and copolymers thereof; polyester resins, such as polyethylene terephthalate and polybutylene terephthalate; polystyrene resins; polyamide resins; copolymers of olefins, such as ethylene or propylene, with other vinyl monomers; ionomers; and cellulose derivatives. These resins may be used alone or as a mixture of two or more. Of these resins, polyester resins and vinyl resins are preferred.

The colorant-receptive layer may contain a release agent for the purpose of preventing heat fusing between the colorant-receptive layer and a thermal transfer sheet during the formation of an image. Silicone oil, phosphate plasticizers, and fluorine compounds may be used as the release agent. Among them, silicone oil is preferred. The amount of the release agent added is preferably 0.2 to 30 parts by weight based on the resin for forming the receptive layer.

The colorant-receptive layer may be coated on the substrate sheet by conventional methods, such as roll coating, bar coating, gravure coating, and gravure reverse coating. The coverage thereof is preferably 0.5 to 10 g/m$^2$ (on a solid basis).

Additional layer

The thermal transfer image-receiving sheet of the present invention may consist of the above substrate sheet and the above colorant-receptive layer alone. If necessary, however, additional layers may be provided.

For example, in order to impart high whiteness and opacity to the image-receiving sheet, a white opaque layer may be provided between the substrate sheet and the colorant-receptive layer.

The white opaque layer may comprise a mixture of a known white inorganic pigment, such as titanium oxide or calcium carbonate, with a binder. The binder may be one of or a blend of known resins such as polyurethane, polyester, polyolefin, modified polyolefin, and acrylic resins.

Further, in order to improve the resistance of the image-receiving sheet to curling associated with printing or curling associated with environment, various plastic films or various types of paper may be laminated on the image-receiving sheet. More specifically, coated paper, art paper, wood-free paper, glassine paper, resin EC paper, a polyester, polypropylene, or the like may be laminated on the substrate sheet on its side remote from the receptive layer. Further, if necessary, the substrate may have a sandwich structure comprising a core formed of one of the above various types of paper or plastic films and substrate sheets laminated on both sides of the core.

Furthermore, a lubricious back surface layer may also be provided on the side of the image-receiving sheet remote from the colorant-receptive layer, according to an image-receiving sheet carrying system of a printer used. The back surface layer is preferably provided by coating a dispersion of an inorganic or organic filler in a resin at a coverage of 0.3 to 3 g/m$^2$. The resin to be used for the lubricious layer may be any known resin. A lubricant, such as silicone, or a release agent may be added to the back surface layer.

The following examples further illustrate the present invention but are not intended to limit it.

In the following examples, "parts" are by weight, and the coverage of the colorant-receptive layer is on a dry basis,

EXAMPLE B1

Compound 1 having the following composition was extruded, and the extrudate was biaxially stretched to prepare a 60 $\mu$m-thick film having microvoids.

| Compound 1 | |
|---|---|
| Polypropylene | 100 parts |
| Polymethyl methacrylate | 8 parts |

This film had a percentage void of 20.9% and a fractal dimension D of 1.63. This film was laminated on both sides of white PET (W-400, manufactured by Diafoil Co., Ltd.) to prepare a substrate.

The substrate on its one surface was coated with a coating solution, for a colorant-receptive layer, having the following composition by gravure reverse coating at a coverage of 4.0 g/m$^2$, thereby preparing a thermal transfer image-receiving sheet.

| Coating solution for colorant-receptive layer | |
|---|---|
| Ethylene/vinyl acetate copolymer (#1000A, manufactured by Denki kagaku Kogyo K.K.) | 7.2 parts |
| Styrene/methyl methacrylate copolymer (#400, manufactured by Denki kagaku Kogyo K.K.) | 1.6 parts |
| Polyester (Vylon 600, manufactured by Toyobo Co., Ltd.) | 11.2 parts |
| Vinyl-modified silicone (X-62-1212, manufactured by Shin-Etsu Chemical Co., Ltd.) | 2.0 parts |
| Methyl ethyl ketone | 39.0 parts |
| Toluene | 39.0 parts |

EXAMPLE B2

Compound 2 having the following composition was extruded, and the extrudate was biaxially stretched to prepare a 60 $\mu$m-thick film having microvoids.

| Compound 2 | |
|---|---|
| Polypropylene | 100 parts |
| Polymethyl methacrylate | 7 parts |

This film had a percentage void of 18.9% and a fractal dimension D of 1.48. The 60 $\mu$m-thick film was laminated on the following coated paper on its side remote from the polyethylene layer, and a coating solution, for a white opaque layer, having the following composition was coated on the side of the 60 $\mu$m-thick film in the same manner as in Example B1, thereby preparing a thermal transfer image-receiving sheet.

| Coated paper | |
|---|---|
| New Top (basis weight: 104.9 g/m$^2$, manufactured by New Oji Paper Co., Ltd.) with a 45 $\mu$m-thick polyethylene layer being formed on one side thereof by extrusion. | |
| Coating solution for white opaque layer | |
| Binder (N-2303, manufactured by Nippon Polyurethane Industry Co., Ltd.) | 10 parts |
| White pigment ($TiO_2$, average particle diameter 0.5 $\mu$m) | 15 parts |
| Organic solvent | 60 parts |

EXAMPLE B3

Compound 3 having the following composition was extruded, and the extrudate was biaxially stretched to prepare a 60 $\mu$m-thick film having microvoids.

| Compound 3 | |
|---|---|
| Polypropylene | 100 parts |
| Polymethyl methacrylate | 5 parts |

This film had a percentage void of 13.6% and a fractal dimension D of 1.59. Thereafter, the procedure of Example B1 was repeated to prepare a thermal transfer image-receiving sheet.

Comparative Example B1

Compound 4 having the following composition was extruded, and the extrudate was biaxially stretched to prepare a 60 $\mu$m-thick film having voids.

| Compound 4 | |
|---|---|
| Polypropylene | 100 parts |
| Calcium carbonate | 10 parts |

This film had a percentage void of 15.6% and a fractal dimension D of 1.40. Thereafter, the procedure of Example B1 was repeated to prepare a thermal transfer image-receiving sheet.

Comparative Example B2

Compound 5 having the following composition was extruded, and the extrudate was biaxially stretched to prepare a 60 $\mu$m-thick film having voids.

| Compound 5 | |
|---|---|
| Polypropylene | 100 parts |
| Titanium oxide | 5 parts |

This film had a percentage void of 16.5% and a fractal dimension D of 1.41. Thereafter, the procedure of Example B1 was repeated to prepare a thermal transfer image-receiving sheet.

A gradation test pattern was printed on the thermal transfer image-receiving sheets prepared in the above examples and comparative examples under conditions of an applied voltage of 15.7 V and a printing speed of 5.5 msec/line. In order to evaluate the sensitivity in printing, the print density in the 9th gradation among 14 gradations was determined by measuring the reflection density with a Macbeth densitometer. The print density was evaluated based on the optical density 1.0. The evaluation criteria are as follows.

O: good with 4% or more improvement over the reference value

Δ: somewhat improved over the reference value

X: lower than the reference value.

The heat resistance was evaluated by visual inspection of the surface appearance of the print (with respect to the presence of trace of a thermal head). The evaluation criteria are as follows.

O: good

Δ: somewhat poor, but still acceptable

X: unacceptable

The results are shown in the following table.

TABLE B1

| Example No. | Percentage void (%) | Fractal dimension | Print density | Heat resistance |
|---|---|---|---|---|
| Ex. B1 | 20.9 | 1.63 | 1.10 (○) | Δ |
| Ex. B2 | 18.9 | 1.48 | 1.23 (○) | ○ |
| Ex. B3 | 13.6 | 1.59 | 1.09 (○) | ○ |
| Comp. Ex. B1 | 15.6 | 1.40 | 1.00 (X) | X |
| Comp. Ex. B2 | 16.5 | 1.41 | 0.92 (X) | X |

Thermal transfer image-receiving sheet having white opaque layer

The thermal transfer image-receiving sheet according to the third aspect of the present invention comprises a substrate and, provided thereon in the following order, an adhesive layer composed mainly of a hydrophilic resin, a white opaque layer and a colorant-receptive layer.

Substrate

The substrate may be formed of any plastic commonly used in the art for a dye sublimation thermal transfer image-receiving sheet. However, the use of a biaxially stretched plastic film having microvoids in its interior (hereinafter referred to as a "foamed film") is preferred because such a plastic film has suitable heat insulating and cushioning properties and high sensitivity in printing, and can provide a sharp image. A foamed film composed mainly of a polyolefin resin, especially a polypropylene resin, is particularly preferred.

A film composed mainly of a resin (such as polyethylene terephthalate) other than the polyolefin, due to high modulus of elasticity of the resin per se, is inferior in cushioning properties even when microvoids are present in the film, and thus is inferior in sensitivity in printing.

There are two methods for forming microvoids in a plastic film. One of them is to carry out suitable biaxial stretching upon the preparation of a film by mixing and kneading a polymer with inorganic fine particles and then extruding the mixture (compound) into a film. Upon the stretching, the inorganic fine particles serve as a nucleus to form microvoids in the film.

Known inorganic pigments, such as titanium oxide, calcium carbonate, barium carbonate, barium sulfate, and zinc oxide, may be used as the inorganic fine particles. The content of the inorganic fine particles in the film is preferably 1 to 20 parts by weight based on 100 parts by weight of the polymer. When the content is too low, the formation of microvoids is insufficient, failing to provide a satisfactory sensitivity in printing to the final product. On the other hand, when it is too high, the formation of the film itself is adversely affected.

The other method for forming microvoids is to carry out suitable biaxial stretching in the preparation of a film by blending a resin as a main component with a polymer immiscible with the resin and extruding the resultant compound into a film. The microscopic observation of this compound reveals that the polymers constitute a fine islands-sea structure. Stretching of the film causes cleavage at the interface of the islands-sea structure or large deformation of the polymer constituting the islands, leading to the formation of microvoids.

When polypropylene is used as the main resin, the immiscible polymer may be any one so far as it has a melting point above polypropylene. Polyesters and polymethyl methacrylate are particularly preferred. Polyethylene terephthalate is preferred as a polyester. Polyesters and polymethyl methacrylate are each preferably used in an amount of 2 to 10 parts by weight based on 100 parts by weight of polypropylene. When the amount of the immiscible polymer is too low, the formation of microvoids is insufficient, failing to provide a satisfactory sensitivity in printing to the final product. On the other hand, when the amount is too high, the heat resistance of the film is lowered.

When the above two methods are compared, the latter method is better. This is because, according to the latter method, the islands-sea structure in the compound can be made very fine simply by an adequate mixing and kneading, resulting in the formation of very fine voids. The presence of smaller microvoids in a larger number can provide superior cushioning properties and heat insulating properties to the film, thus providing higher sensitivity in printing to the resulting image-receiving sheet.

In order that the foamed film thus formed has appropriate sensitivity in printing and, at the same time, high heat resistance enough to prevent traces of a thermal head from being left on the image-receiving sheet after printing, the apparent specific gravity of the film and the shape of the microvoids are important.

The apparent specific gravity is preferably 0.50 to 0.75. As regards the shape of microvoids, it is preferred that they be as spherical as possible, though many of them are in fact flat.

When the above foamed film is used as the substrate, the substrate may have a single layer structure. Alternatively, an additional plastic film layer may be laminated on one or the both sides of the foamed film according to the desired appearance of the image-receiving sheet, such as gloss, matting, opacity and whiteness. The additional film layer may be formed by co-extruding the foamed film and the additional film layer.

For example, in order to impart gloss, a surface skin layer may be provided on one or the both sides of the foamed film as a core layer. The surface skin layer is preferably formed of a polyolefin resin, particularly polypropylene, from the viewpoint of moldability and the adhesion to the core layer.

The thickness of the surface skin layer is preferably 1 to 10 $\mu$m. When it is less than 1 $\mu$m, the gloss is insufficient. On the other hand, when it exceeds 10 μm, the sensitivity in printing is adversely affected.

As the above foamed film having a multilayer structure, use may be made of a commercially available synthetic paper, for example, the synthetic paper sold under the trade name "Yupo", which is a laminated foamed polypropylene.

Further, in order to prevent curling due to heat from a thermal head at the time of printing, it is also possible to laminate a support onto the above foamed film having a single layer or multilayer structure.

The support, as compared with the foamed film, preferably has a higher modulus of elasticity under ordinary room environment and better heat stability in respect of heat shrinkage. Specific preferred examples of support include coated paper, art paper, glassine paper, wood-free paper, cast-coated paper, and other cellulosic papers. The modulus of elasticity of these papers as measured at a temperature of 20° C. and a humidity of 50% is generally not less than $1\times10^{10}$ Pa. The degree of shrinkage of these papers, when allowed to stand at 110° C. for 60 sec, is generally 0 to 0.5%.

Further, it is also possible to use as the support a PET film, a foamed PET film, a white PET film, an acrylic film, and the like. The modulus of elasticity of these films at 20° C. is generally about $5\times10^{9}$ to $2\times10^{10}$ Pa. The degree of shrinkage of these films, when allowed to stand at 110° C. for 60 sec, is generally 0 to 1.0%.

The support is usually laminated onto the above foamed film, on its side remote from the side on which a colorant-receptive layer is to be formed. The lamination may be carried out by a known method, such as dry lamination, wet lamination, EC lamination, or heat sealing.

The support may consist of the above paper or PET film alone. Alternatively, in order to further enhance the resistance to curling upon printing, the support may have such a multilayer structure that an anti-curling layer is provided on the surface of the support remote from the foamed film. The anti-curling layer is preferably formed of a polyolefin resin. Further, the same film as the above foamed film having a single layer or multilayer structure may be laminated as the anti-curling layer.

The thickness of the support is preferably about 50 to 120 μm from the viewpoint of the rigidity of the image-receiving sheet and the suitability for the image-receiving sheet to be carried through a printer. The anti-curling layer in the support is preferably about 25 to 60 μm. The thickness of the whole image-receiving sheet is preferably about 100 to 250 μm.

Colorant-receptive layer

The resin usable for the colorant-receptive layer may be any resin conventionally used for dye sublimation thermal transfer image-receiving sheets. Specific examples of the resin include polyolefin resins, such as a polypropylene; halogenated resins, such as polyvinyl chloride and polyvinylidene chloride; vinyl resins, such as polyvinyl acetate and polyacrylic ester, and copolymers thereof; polyester resins, such as polyethylene terephthalate and polybutylene terephthalate; polystyrene resins; polyamide resins; copolymers of olefins, such as ethylene or propylene, with other vinyl monomers; ionomers; and cellulose derivatives. These resins may be used alone or as a mixture of two or more. Of these resins, polyester resins and vinyl resins are preferred.

The colorant-receptive layer may contain a release agent for the purpose of preventing heat fusing between the colorant-receptive layer and a thermal transfer sheet during the formation of an image. Silicone oil, phosphate plasticizers, and fluorine compounds may be used as the release agent. Among them, silicone oil is preferred. The amount of the release agent added is preferably 0.2 to 30 parts by weight based on the resin for forming the receptive layer.

The colorant-receptive layer may be coated on the substrate sheet by conventional methods, such as roll coating, bar coating, gravure coating, and gravure reverse coating. The coverage thereof is preferably 0.5 to 10 g/m$^2$ (on a solid basis).

White opaque layer

A white opaque layer is provided between the above substrate and the colorant-receptive layer. The white opaque layer serves to impart whiteness and opacity to the thermal transfer image-receiving sheet.

Incorporation of a white pigment in the substrate per se is known as a method for imparting whiteness and opacity to the image-receiving sheet. This method can impart opacity to the image-receiving sheet. However, the surface color inherent in the substrate used still appears, whereby it is not always possible to obtain sufficient whiteness.

For obtaining sufficient whiteness in addition to opacity, a more effective method is to provide a white opaque layer between the colorant-receptive layer and the substrate.

The white opaque layer preferably comprises a resin as a binder and a white pigment dispersed therein.

Known resins, such as chlorinated polypropylene, polyurethane, polycarbonate, polymethyl methacrylate, polyesters, and polystyrene, and modified products thereof may be used as the binder resins. These resins may be used alone or as a blend of two or more.

Examples of the white pigment include known inorganic pigments, such as titanium oxide, calcium carbonate, barium sulfate, and zinc oxide. Among them, anataze-type titanium oxide is preferred from the viewpoint of whiteness and opacity.

The amount of the white pigment is preferably 30 to 300 parts based on 100 parts by weight of the binder. When the amount of the white pigment is below the above range, whiteness and opacity, particularly opacity, is insufficient. On the other hand, when the amount of the white pigment exceeds the above range, the processability upon the formation of the layer is poor and, at the same time, the formed layer in very fragile.

The white opaque layer may, if necessary, contain additives such as a fluorescent brightening agent.

Further, various curing agents suitable for the binder used in the white opaque layer may also be added so as to enhance the adhesion between the white opaque layer and the substrate. When the binder resin used has a hydroxyl group, the use of various isocyanates as the curing agent is most effective. The use of the isocyanates can remarkably enhance the adhesion because a hydrophilic resin is used as an adhesive layer provided on the substrate, as described below.

Adhesive layer

When the above white opaque layer and colorant-receptive layer are formed on the above substrate, the adhesion between the substrate and the white opaque layer is generally insufficient, causing partial or entire delamination between the substrate and the white opaque layer at the time of printing. This often leads to printing errors or troubles during carrying of the image-receiving sheet within a printer.

Especially, when a foamed polypropylene film is used as the substrate, the surface free energy of the film per se is relatively low, and the adhesion is inferior to that of films of other materials.

The formation of an adhesive layer using a resin, which is soluble in an organic solvent, on the substrate for the purpose of improving the adhesion between the substrate and the white opaque layer results in significant deterioration in the appearance of the image-receiving sheet because the adhesive layer is attacked by an organic solvent contained in the coating solution for a white opaque layer when a white opaque layer is formed.

The present invention have solved this problem by using a hydrophilic resin as a material for forming the adhesive layer. The adhesive layer composed mainly of a hydrophilic resin can effectively enhance the adhesion between the substrate and the white opaque layer. The bonding effect attained by this adhesive layer is superior in the stability with time to that attained by corona treatment or plasma treatment in the prior art. Further, this adhesive layer is not influenced by the solvent contained in the coating solution for a white opaque layer, whereby the original texture of the surface of the substrate can be maintained.

Known hydrophilic resins, such as polyvinyl alcohol, hydroxypropyl cellulose, and polyethylene glycol, may be used as the hydrophilic resin. Among them, polyvinyl alcohol is particularly preferred from the viewpoint of processability and adhesive properties.

The thickness of the adhesive layer is preferably 0.1 to 2.0 μm. When it is less than 0.1 μm, the improvement in adhesion is insufficient. On the other hand, when it exceeds 2.0 μm, the sensitivity in printing can be adversely affected.

The adhesive layer may be formed by any conventional coating method, as in the case of the formation of the colorant-receptive layer.

Further, when the substrate comprises the above foamed film (having a single layer or multilayer structure) and the above support, additional provision of an adhesive layer between the foamed film and the support is preferred in order to improve the adhesion between the foamed film and the support. In the case of this additional layer, use may be made of both a resin soluble in an organic solvent, such as an acrylic resin, and a hydrophilic resin as mentioned above.

The following examples further illustrate the present invention but are not intended to limit it.

In the following examples, "parts" are by weight, and the coverage of the colorant-receptive layer and the white opaque layer is on a dry basis.

EXAMPLE C1

A foamed polypropylene film having an about 1 μm-thick adhesive layer of polyvinyl alcohol (35MWS46, manufactured by Mobil Plastics Europe) was provided as a substrate film. The substrate film was laminated with a urethane resin adhesive onto a coated paper {OK Coat having a 33 μm-thick PE layer (basis weight: 157 g/m$^2$), manufactured by New Oji Paper Co., Ltd.} as a support by dry lamination so that the support in its surface remote from the PE layer faced the substrate film in its surface remote from the polyvinyl alcohol layer. The thickness of the urethane resin adhesive layer formed between the foamed polypropylene film and the support was about 1 μm. The resultant laminate on its polyvinyl alcohol layer was coated with a coating solution, for a white opaque layer, having the following composition and a coating solution, for a colorant-receptive layer, having the following composition in that order respectively at coverages of 2.5 g/m$^2$ and 4.2 g/m$^2$.

| Coating solution for white opaque layer | |
|---|---|
| Polyurethane resin (N-5199, manufactured by Nippon Polyurethane Industry Co., Ltd.) | 10.0 parts |
| Titanium oxide (average particle diameter: 0.5 μm) | 10.0 parts |
| Isocyanate (XA-14, manufactured by Takeda Chemical Industries, Ltd.) | 3.0 parts |
| Methyl ethyl ketone | 48.5 parts |
| Toluene | 48.5 parts |

| Coating solution for colorant-receptive layer | |
|---|---|
| Ethylene/vinyl acetate copolymer (#1000A, manufactured by Denki kagaku Kogyo K.K.) | 7.2 parts |
| Styrene/methyl methacrylate copolymer (#400A, manufactured by Denki kagaku Kogyo K.K.) | 1.6 parts |
| Polyester (Vylon 600, manufactured by Toyobo Co., Ltd.) | 11.2 parts |
| Vinyl-modified silicone (X-62-1212, manufactured by Shin-Etsu Chemical CO., Ltd.) | 2.0 parts |
| Methyl ethyl ketone | 39 parts |
| Toluene | 39 parts |

Comparative Example C1

The procedure of Example C1 was repeated, except that a foamed plastic film (40MW647, manufactured by Mobil Plastics Europe) provided with an acrylic resin adhesive layer (thickness: 1 μm) instead of the polyvinyl alcohol adhesive layer was used.

Comparative Example C2

The procedure of Example C1 was repeated, except that a foamed polypropylene film {PL-BT (thickness: 35 μm), manufactured by Futamura Sansyo Co., Ltd.}, the both sides of which had been subjected to a corona treatment, was used instead of the foamed polypropylene film used in Example C1.

Comparative Example C3

The procedure of Example C1 was repeated, except that a foamed polypropylene film (38MW247, manufactured by Mobil Plastics Europe), wherein the white opaque layer side thereof had been subjected to a corona treatment with the support side thereof being untreated, was used instead of the foamed polypropylene film used in Example C1.

The thermal transfer image-receiving sheets prepared in the above example and comparative examples were evaluated as follows. The results are given in Table C1.

(1) Sensitivity in printing

A gradation test pattern was printed under conditions of an applied voltage of 15.7 V and a printing speed of 5.5 msec/line, and the print density in the 9th gradation among 14 gradations was measured with a Macbeth densitometer. The results were evaluated as follows.

The print density was evaluated based on the optical density 1.0. The evaluation criteria are as follows.

O: not less than 1.10

Δ: 0.95–1.09

X: not more than 0.94

(2) Appearance:

The appearance was evaluated by visual inspection.

O: good

X: poor (3) Adhesive property (abnormal transfer phenomenon)

A solid cross hatching pattern was printed for three colors by means of a VY-P1 printer manufactured by Hitachi, Ltd. The adhesive property was evaluated in terms of the surface appearance of the image-receiving sheet after the printing and the state of the image-receiving sheet when it is carried in a printer.

X: part of the coated layer peeled from the foamed polypropylene film

Δ: carrying error occurred during printing

O: no problem

TABLE C1

| Example No. | Sensitivity in printing | Appearance | Adhesive property |
|---|---|---|---|
| Ex. C1 | ○ | ○ | ○ |
| Comp.Ex. C1 | ○ | X | ○ |
| Comp.Ex. C2 | Δ | ○ | X |
| Comp.Ex. C3 | X | ○ | Δ |

What is claimed is:

1. A thermal transfer image-receiving sheet comprising a substrate and a colorant-receptive layer, said substrate comprising a plastic film having microvoids, the fractal dimension of said microvoids being not less than 1.45.

2. The thermal transfer image-receiving sheet according to claim 1, wherein said plastic film having microvoids is formed by extruding a mixture containing a main resin and a polymer immiscible with said main resin and biaxially stretching the resultant extrudate.

3. The thermal transfer image-receiving sheet according to claim 2, wherein said main resin is polypropylene and said polymer immiscible with said main resin is polymethyl methacrylate.

* * * * *